US005887360A

United States Patent [19]

Bucalo et al.

[11] Patent Number: 5,887,360

[45] Date of Patent: Mar. 30, 1999

[54] ADJUSTABLE HEEL ASSEMBLY AND SHOE INCLUDING THE SAME

[76] Inventors: Gladys Lopez Bucalo; Brian D. Bucalo, both of 3600 Mystic Pointe Dr., #1613, Aventura, Fla. 33180

[21] Appl. No.: 982,664

[22] Filed: Dec. 2, 1997

[51] Int. Cl.[6] ..... A43B 3/24; A43B 21/36

[52] U.S. Cl. ..... 36/100; 36/42

[58] Field of Search ..... 36/81, 100, 101, 36/42, 34 R

[56] References Cited

U.S. PATENT DOCUMENTS

| | | | |
|---|---|---|---|
| 2,707,341 | 5/1955 | Ramano | 36/42 X |
| 2,767,489 | 10/1956 | Sturman | 36/42 X |
| 3,805,418 | 4/1974 | Matuka et al. | 36/42 X |
| 4,416,072 | 11/1983 | Sarkissian | 36/42 X |
| 4,805,320 | 2/1989 | Goldenberg et al. | 36/42 |
| 5,079,857 | 1/1992 | Clifton | 36/42 |

FOREIGN PATENT DOCUMENTS

| | | | |
|---|---|---|---|
| 350445 | 3/1922 | Germany | 36/81 |

*Primary Examiner*—B. Dayoan
*Attorney, Agent, or Firm*—Steinberg & Raskin, P.C.

[57] ABSTRACT

A shoe having an upper, a sole and an adjustable heel including a first heel member connected to the sole at a rear portion thereof and a second heel member arranged at least partially within the first heel member. The second heel member is movable relative to the first member between a first position in which the first and second heel members provide the heel with a first height and a second position in which the first and second heel members provide the heel with a second height greater than the first height. In the first position of the second heel member, the second heel member is arranged partially within the first heel member whereas in the second position of the second heel member, the second heel member is arranged below the first heel member.

20 Claims, 4 Drawing Sheets

ADJUSTABLE HEEL ASSEMBLY AND SHOE INCLUDING THE SAME

FIELD OF THE INVENTION

The present invention relates to a shoe having an adjustable heel which enables the shoe to be worn at multiple heel heights and more particularly, to womens' high-heel shoes having an adjustable heel which enables an alternative, lower height of the heel.

BACKGROUND OF THE INVENTION

Currently available high-heel shoes for women have a relatively large heel which is fixed to the sole and has a single, predetermined height. This fact has some significant disadvantages for the wearer. In particular, individuals wearing high-heel shoes often experience fatigue or discomfort in their feet because the high heel requires the foot to be bent into an unnatural position. It is also known that prolonged wearing of high-heel shoes can lead to more serious foot problems. Furthermore, some women prefer to wear shoes with relatively low heels at one time of the day, for example, while commuting to work, and then change to shoes with relatively high heels while at work and again back to the shoes with low heels after work.

In order to relieve foot fatigue or discomfort, prevent the development of foot problems or meet personal preferences, a woman is therefore compelled to change from shoes having a relatively high heel to another pair of shoes with a different, lower heel height. It is inconvenient to carry another such pair of shoes and the process of changing shoes is very time consuming.

OBJECTS AND SUMMARY OF THE INVENTION

Accordingly, it is an object of the present invention to avoid the above-mentioned drawbacks of prior art shoes having a heel with a single predetermined height.

In particular, it is an object of the present invention to provide a shoe with a heel which is adjustable in height thereby avoiding the necessity of carrying additional shoes, special tools, or spare heels of different sizes in order to alter the height of the heel.

It is an additional object of the present invention to provide a shoe which provides a choice of wearing styles for the wearer by permitting an adjustment in the heel height.

In order to attain these objects and others, the adjustable heel for a shoe in accordance with the invention generally comprises two heel members, one of which is arranged at the rear of the downwardly facing surface of and fixed to the body of the shoe, which is usually the sole, and the other of which is movable to at least two positions relative to the fixed member so that in each position, the height of the rear of the body of the shoe is different than the other position(s). The movable heel member is moved between the positions to provide for the desired heel height, e.g., a low heel height during a commute to and from work and a high heel height during work.

In one embodiment of the invention, the first member is an outer heel casing including an interior compartment and the second member is an inner heel block selectively positionable at least partially within the interior compartment of the outer heel casing. At least two vertically, spaced apertures are formed in the outer heel casing and a hole is formed in a peripheral surface of the inner heel block alignable with each of the apertures in the outer heel casing. The heel also includes a pin arranged in the hole in the inner heel block, and biasing means for biasing the pin outward from the hole such that the pin can extend at least partially through each aperture in the outer heel casing when in alignment therewith. Thus, when the pin extends through the uppermost aperture in the outer heel casing, the inner heel block remains at a fixed position relative to the outer heel casing in which the heel is at its lowest height and when the pin extends through the lowermost aperture in the outer heel casing, the inner heel block remains at a fixed position in which the heel is at its highest height.

In another related embodiment, the shoe comprises a sole, an upper arranged in connection with and above the sole and a heel arranged below the sole. The heel includes a first, downwardly oriented heel member arranged at a rear portion of and connected to the sole, a second heel member positionable at least partially within an interior compartment of the first heel member, and displacement means for enabling displacement of the second heel member relative to the first member. The second heel member is movable between a first position in which the first heel member and the second heel member provide the heel with a first height and a second position in which the first heel member and the second heel member provide the heel with a second height greater than the first height. The displacement means comprise at least two vertically spaced apertures in the first heel member, a hole in a peripheral surface in the second heel member alignable with each aperture, a pin arranged in the hole in the second heel member and biasing means for biasing the pin outward from the hole and at least partially through one of the apertures in the first heel member when the pin is in alignment therewith.

In another embodiment of the invention, the first member is a heel fixedly mounted to the sole and includes a first forward section and a second rearward section and an open section or hollow compartment situated between the first and second sections, and the second member is a heel extension member arranged in the open section or hollow compartment. Coupling means are provided to couple the second member to the first member and may comprise a receptacle arranged on a lower surface of the fixed heel which is lower than the lower surface of the heel extension member so as to serve as the bottom of the heel when in the "low heel" height, a cooperating snap pin arranged on the lower surface of the heel extension member and a hinge for rotatably coupling the fixed heel to the heel extension member such that the heel extension member is pivotable to allow engagement of the snap pin in the receptacle thereby connecting the heel extension member to the fixed heel. The hinge comprises a first plate connected to the lower surface of the heel extension member and a second plate connected to a side surface of the fixed heel. The second plate comprises a vertically oriented slot and a pin is connected to the fixed heel through the slot such that the second plate and thus the hinge are movable relative to the pin and thus the fixed heel, e.g. to a position in which the lower surface of the heel extension member is below the lower surface of the fixed heel to enable the first plate and thus the heel extension member to rotate. Locking means may be provided for locking the heel extension member in the first position, and comprise a snap pin arranged on a lower surface of the sole, and a cooperating receptacle arranged on an upper surface of the heel extension member. Other cooperating locking structures may also be provided without deviating from the scope and spirit of the invention.

BRIEF DESCRIPTION OF THE DRAWINGS

A more complete appreciation of the present invention and many of the attendant advantages thereof will be readily understood by reference to the following detailed description of the invention when considered in connection with the accompanying drawings in which.

DETAILED DESCRIPTION OF THE PREFERRED EMBODIMENTS

Figure 1:
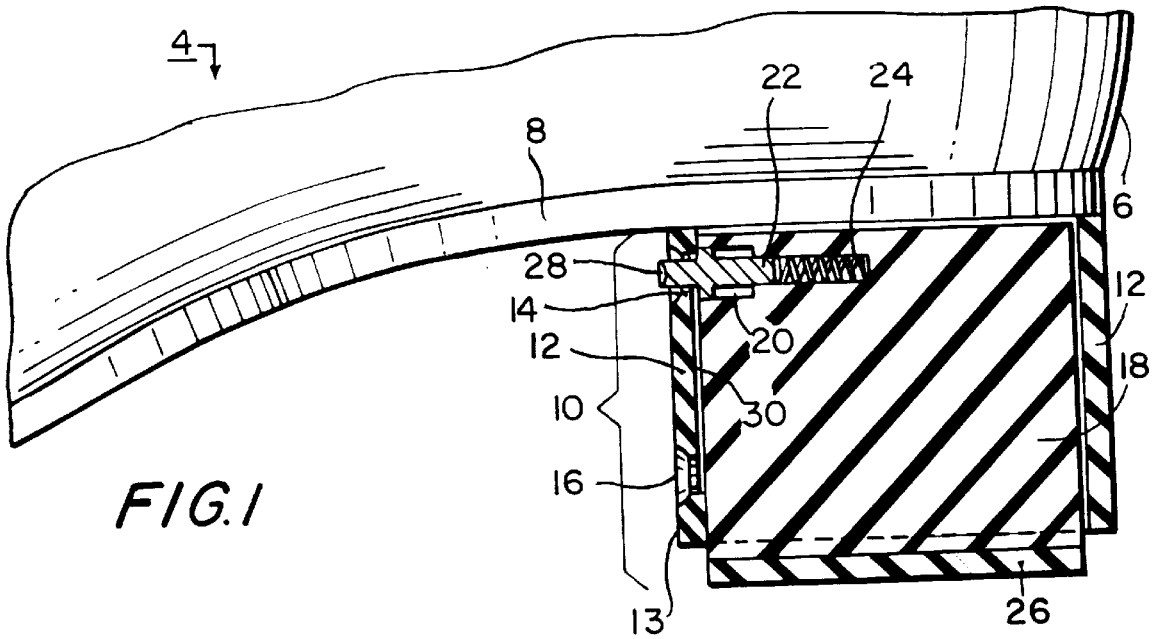
FIG. 1 is a cross-sectional view of a first embodiment of a shoe having an adjustable heel in accordance with the invention wherein the heel has a first height.
Figure 2:
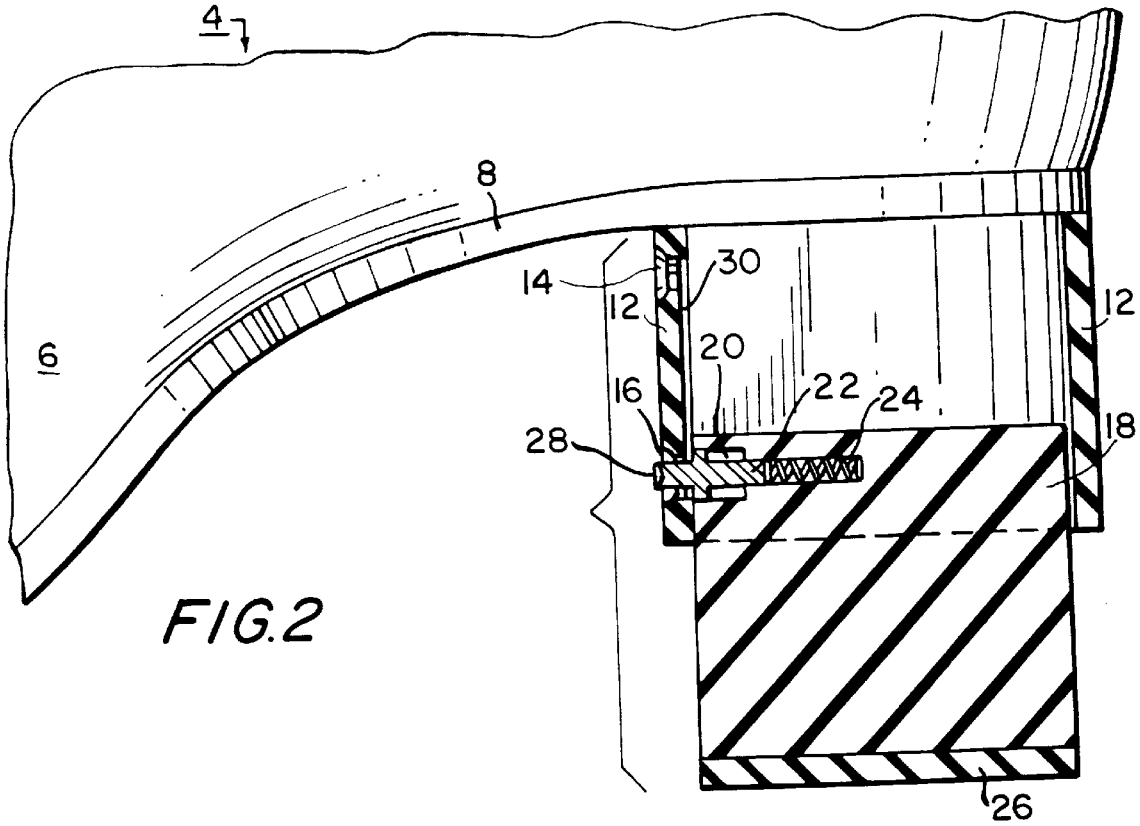
FIG. 2 is a cross-sectional view of the embodiment of the shoe shown in FIG. 1 in which the heel has a second height greater than the first shown in FIG. 1.

Referring to the accompanying drawings wherein like reference characters designate identical or corresponding parts throughout the several views, FIGS. 1 and 2 show a first embodiment of a shoe designated generally as 4 having an adjustable heel assembly in accordance with the invention including an upper 6 and a flexible sole 8 made from typical materials therefor, e.g., a stiff but somewhat flexible material, whereby the upper 6 is arranged in connection with and above the sole 8. The stiffness and flexibility of the sole 8 may vary along different points of its length. The shoe 4 also includes heel assembly 10 in accordance with the invention which comprises a downwardly, oriented outer heel casing 12 defined by walls cooperating to provide the desired shape of the heel and which is mounted to the downwardly facing surface of the sole 8 A forward facing wall 13 of the outer heel casing 12 has countersunk apertures 14 and 16 vertically spaced from one another and having the same form. Although only two apertures are shown, it is possible to provide more than two apertures to enable additional possible heights of the heel.

The heel assembly 10 also includes a movable inner heel block 18 positionable at least partially within an interior compartment of the outer heel casing 12 as shown in FIG. 1. Inner heel block 18 is defined by walls cooperating to provide a suitable shape for the heel. A portion of the inner heel block 18 extends through an opening in the lower surface of the outer heel casing 12 which will automatically extend for the purpose discussed below. Inner heel block 18 includes a stepped recess or hole 20 formed in a peripheral surface of inner heel block 18, e.g., by drilling, adjacent the forward facing wall 13 of the outer heel casing 12. Stepped hole 20 has a first portion having a first diameter and a second portion having a second diameter greater than the first diameter thereby providing a step between the first and second portions, the second, larger-diameter portion adjoining the peripheral surface of the inner heel block 18. A elongate, flanged pin 22 is arranged within the stepped hole 20 and is pushed forward to extend at least partially through aperture 14 by the action of biasing means such as a spring 24 as shown in FIG. 1. The pin 22 includes a flange in an intermediate position thereon movable in the second portion of the stepped hole 20 whereas the spring 24 is arranged in the first portion of the stepped hole 20.

Release of the pin 22 from the stepped hole 20 is prevented by the outward extending flange on the pin 22 which contacts the inner surface of the forward facing wall 13 of the outer heel casing 12 in the extreme extended position (the size of the apertures 14,16 being smaller than the size of the flange on the pin 22).

A rubber heel 26 is arranged on the lower surface of inner heel block 18 and constitutes the lowermost surface of the heel assembly 10 which contacts the ground regardless of the position of the inner heel block 18 relative to the outer heel casing 12.

To adjust the height of the heel assembly 10 from the position shown in FIG. 1 wherein the heel assembly 10 is in its "low" position to the position shown in FIG. 2 wherein the heel assembly 10 is in its "high" position, the pin 22 is pushed inward with the tip of a finger or another pointed object such as a pencil or pen until the pin 22 is entirely within the outer heel casing 12. To this end, a dimple 28 is arranged on the outer surface of the pin 22 and facilitates pushing of pin 22 with a pointed object. As the pin 22 is pushed inward into the stepped hole 20, the spring 24 is compressed. The inner heel block 18 is then manually grasped, e.g., by the rubber heel 26 which projects slightly from the outer heel casing 12, and pulled out of the interior of the outer heel casing 12 thereby extending the inner heel block 18 outside of the outer heel casing 12. Means for guiding the movement of the pin 22 between the apertures 14,16 are provided and comprise a groove 30 formed in the inner surface of the forward facing wall 13 of the outer heel casing 12 extending between the apertures 14,16. The groove 30 serves to guide the pin 22 traveling in a straight line as the inner heel block 18 is moved. The interaction of the groove 30 and the pin 22 also prevents the inner heel block 18 and the outer heel casing 12 from rotating relative to each other. When extending the heel assembly 10, the pin 22 moves in the groove 30 from the aperture 14 and, once the inner heel block 18 reaches a predetermined, desired extended position, it will align with aperture 16. When the pin 22 aligns with the aperture 16, the pin 22 then snaps forward into aperture 16 in view of the extension of the compressed spring 24. The inner heel block 18 is now secured in the extended position.

To return the inner heel block 18 to the "housed" position shown in FIG. 1, the pin 22 is pushed inward until it is entirely within the outer heel casing 12 to thereby compress the spring 24. The inner heel block 18 is then pushed into the interior of the outer heel casing 12. The pin 22 moves in the groove 30 from the aperture 16 until it aligns with aperture 14. When the pin 22 aligns with the aperture 14, the pin 22 then snaps forward into aperture 14 in view of the extension of the compressed spring 24. The inner heel block 18 is now secured in the housed position.

Figure 1A:
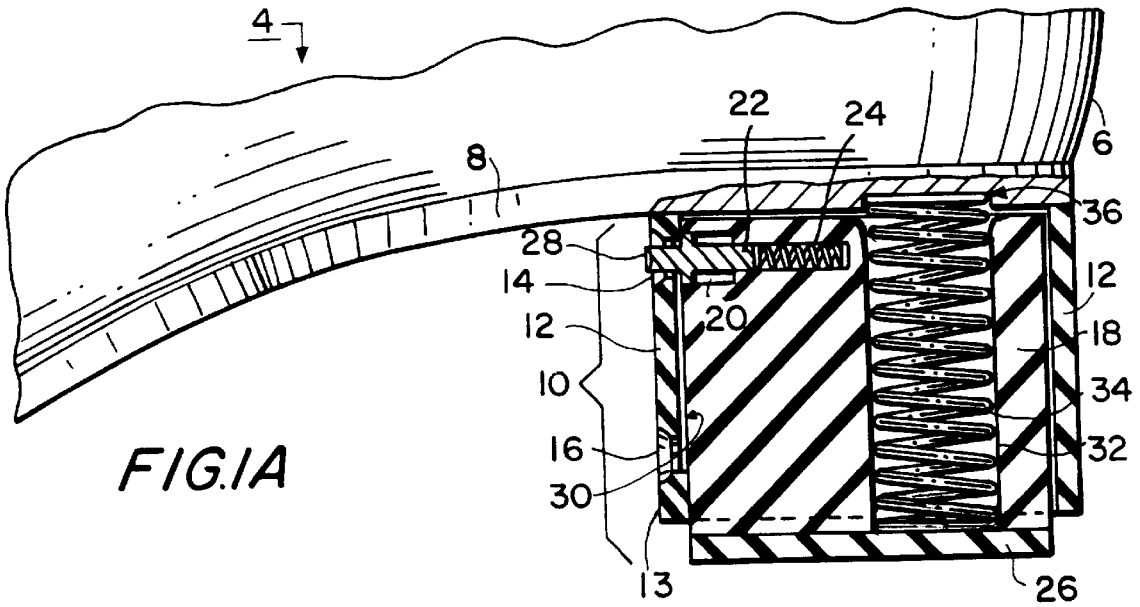
FIG. 1A a cross-sectional view of a modified embodiment of the shoe shown in FIG. 1 which provides automatic extension of the heel.
Figure 2A:
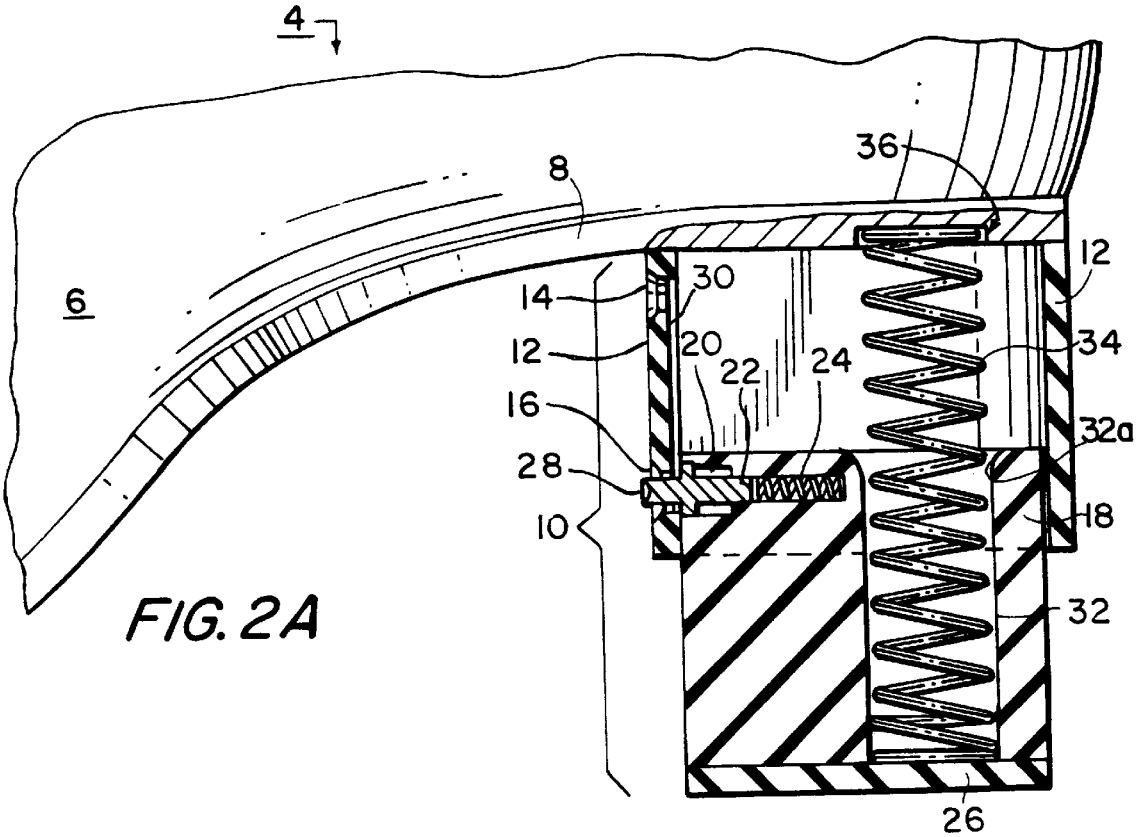
FIG. 2A is a cross-sectional view of the embodiment of the shoe shown in FIG. 1A in which the heel has a second height greater than the first shown in FIG. 1A.

Instead of manually grasping the inner heel block 18 to move the inner heel block 18 to its extended position, one embodiment of the shoe 4 in accordance with the invention includes means for automatically extending the inner heel block 18. In this manner, it is not necessary to grasp a potentially dirty heel. As shown in FIGS. 1A and 2A, one manifestation of such means for automatically extending the inner heel block 18 includes a compression spring 34 arranged inside a vertical channel 32 formed in the inner heel block 18. Vertical channel 32 has rounded edges 32*a* and the spring 34 is placed inside the channel 32 so that one end of the spring 34 is at the bottom of the channel 32, possibly fixedly mounted to the lower wall of the inner heel block 18, and the other end of the spring 34 is snugly press-fitted into a recess 36 formed in the lower surface of the sole 8, and also possibly fixedly mounted thereto. When the heel assembly 10 is in its "low" position, the spring 34 is compressed thereby exerting a force to push the inner heel block 18 outward. However, in the position shown in FIG. 1A, the inner heel block 18 is restrained and prevented from extending outward by the interference of the pin 22 extending through the aperture 14.

To adjust the height of the heel assembly 10 from the position shown in FIG. 1A wherein the heel assembly 10 is in its "low" position to the position shown in FIG. 2A wherein the heel assembly 10 is in its "high" position, the pin 22 is pushed inward until it is entirely within the outer heel casing 12. As such, the restraint provided by the extension of the pin 22 through aperture 14 on the force exerted by the spring 34 to push the inner heel block 18 outward is eliminated and thus, the inner heel block 18 is then free to automatically extend outside of the outer heel casing 12 by the force exerted by the compressed spring 34. The groove 30 serves to guide the pin 22 in its automatic extension in a straight line as the inner heel block 18 is automatically forced outward of the outer heel casing 12. When extending the heel assembly 10, the pin 22 moves in the groove 30 from the aperture 14 and, once the inner heel block 18 reaches a predetermined, desired extended position, it will align with aperture 16. When the pin 22 aligns with the aperture 16, the pin 22 then snaps forward into aperture 16 in view of the extension of the compressed spring 24. The inner heel block 18 is now secured in the extended position.

Other comparable arrangements whereby the inner heel block 18 is automatically extended from the outer heel casing 12, i.e., without requiring manual contact of the inner heel block 18, can also be used in the invention without deviating from the scope and spirit thereof.

To return the inner heel block 18 to the housing position shown in FIG. 1, the pin 22 is pushed inward until it is entirely within the outer heel casing 12 to thereby compress the spring 24. By stepping on the shoe 4, the inner heel block 18 is then pushed into the interior of the outer heel casing 12 against the force of the spring 34 thereby compressing the same. The pin 22 moves in the groove 30 from the aperture 16 until it aligns with aperture 14. When the pin 22 aligns with the aperture 14, the pin 22 then snaps forward into aperture 14 in view of the extension of the compressed spring 24. The inner heel block 18 is now secured in the housed position.

The spring 34 could also be configured to store energy while under tension instead of compression. This would permit the inner heel block 18 to be automatically retracted instead of extended.

FIGS. 3–6 illustrate a second embodiment of the invention in which the shoe designated generally as 37 includes an upper 38 and a flexible sole 40 made from a stiff but flexible material and a heel assembly 42 in accordance with the invention. Heel assembly 42 comprises a heel 44 fixed to the sole 40 and having a first forward section 44*a* and a second rear section 44*b* and defining a hollow storage compartment 46 in its mid section between the forward and rear sections 44*a*,44*b*. Heel 44 is defined by outer walls cooperating to provide the desired shape of the heel or a solid block having a form of the desired shape of the heel. Forward and rear sections 44*a*,44*b* may be connected to one another or separated from one another. Storage compartment 46 contains a heel extension member 48 attached to the fixed heel 44 via a hinge 50. Heel extension member 48 is defined by walls cooperating to provide a desired shape for the heel or a solid block having a form of the desired shape of the heel.

Figure 5:
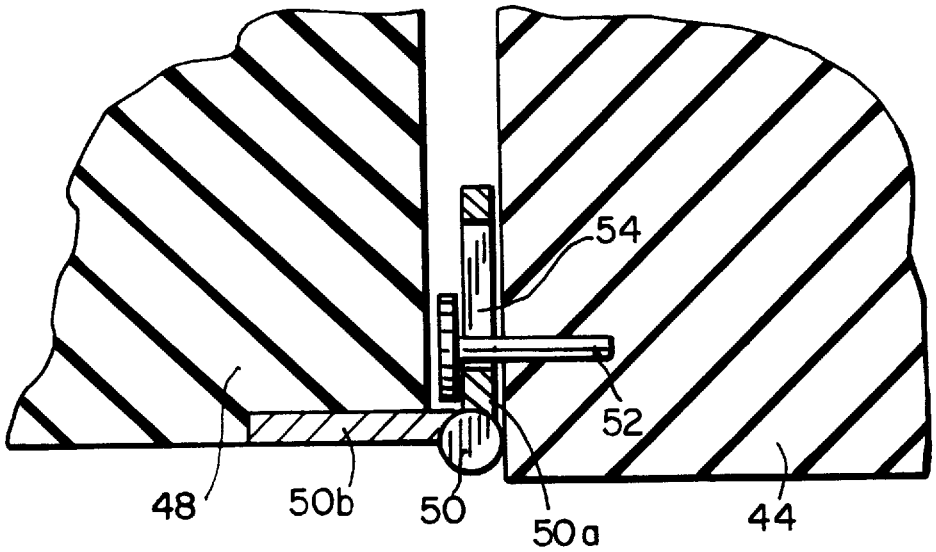
FIG. 5 is an enlarged view of the circle labeled 5 in FIG. 3.
Figure 6:
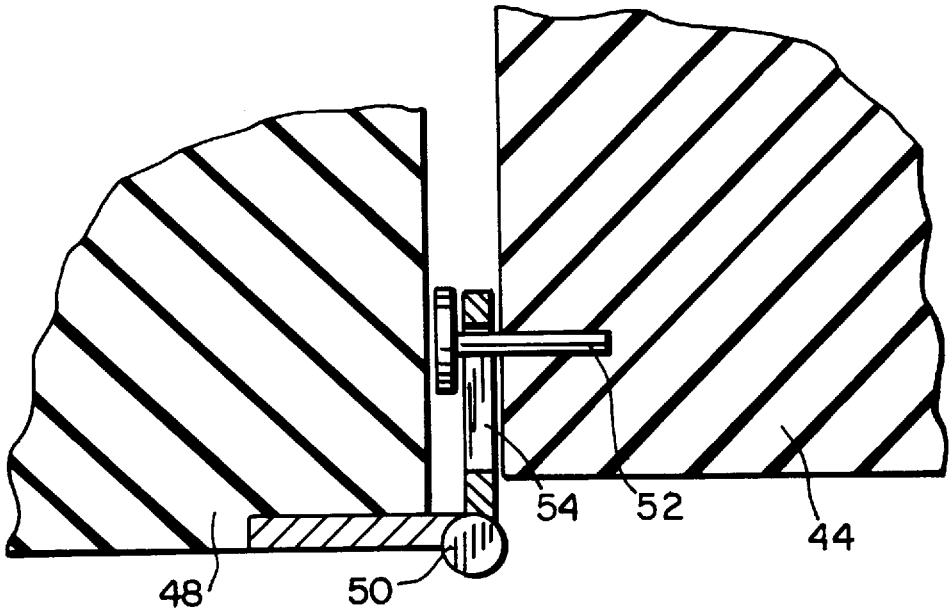
FIG. 6 is a view similar to FIG. 5 showing the heel extension member ready to be moved into the extended position.

As shown in FIG. 5, hinge 50 comprises a first substantially planar plate 50*a* adjacent to the fixed heel 44 and coupled thereto via a pin 52 and a second substantially planar plate 50*b* attached to the heel extension member 48. Pin 52 extends through a vertical slot 54 in the hinge plate 50*a* and is inserted into the fixed heel 44. The pin 52 is movable relative to slot 54, i.e., the hinge 50 is movable relative to the pin 52 which is fixedly connected to the fixed heel 44.

Figure 3:
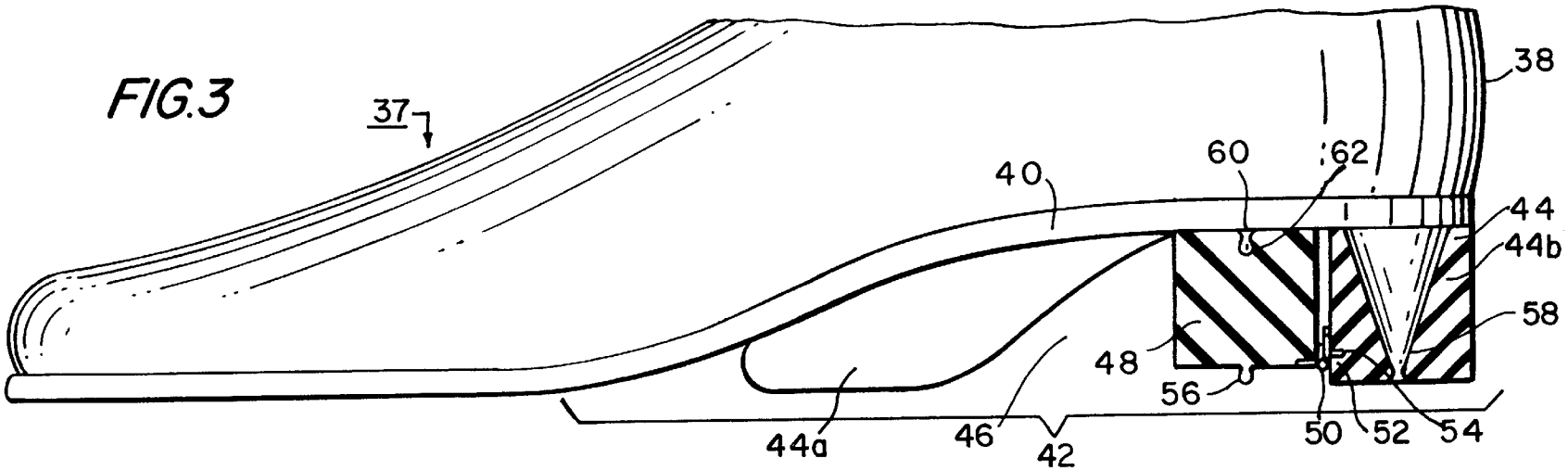
FIG. 3 is a cross-sectional view of a second embodiment of a shoe having an adjustable heel in accordance with the invention wherein the heel has a first height.
Figure 4:
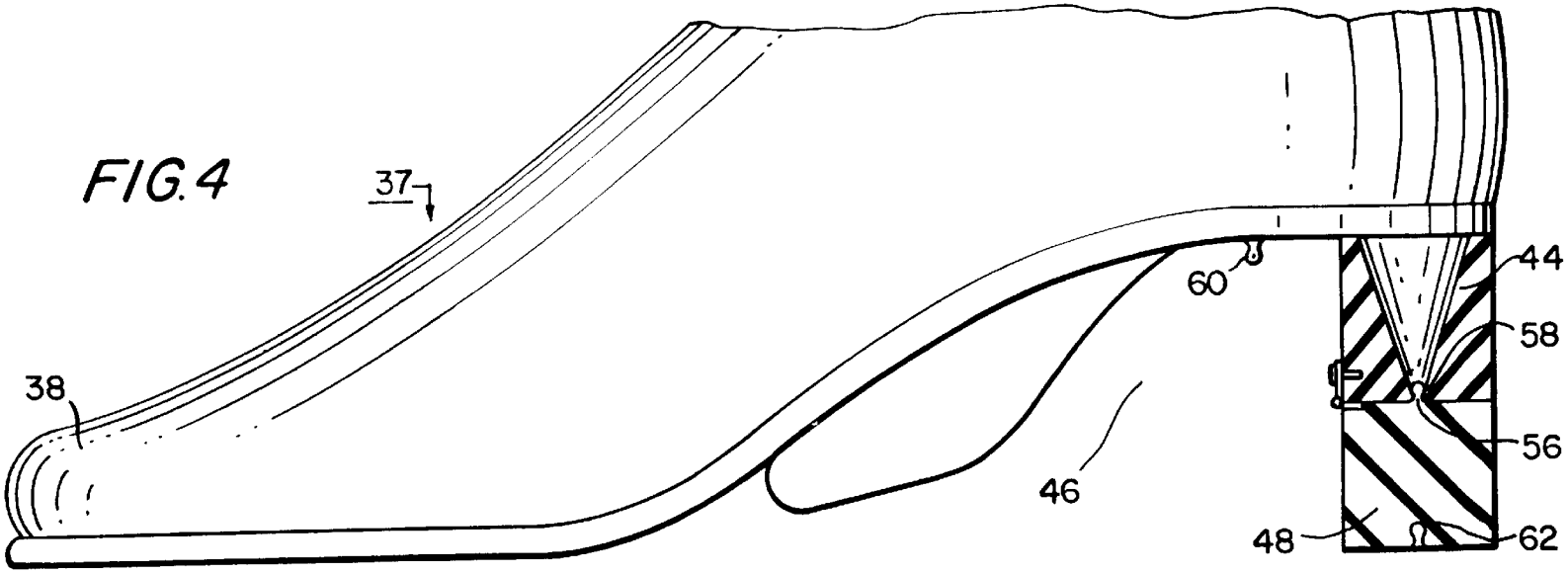
FIG. 4 is a cross-sectional view of the embodiment of the shoe shown in FIG. 3 in which the heel has a second height greater than the first shown in FIG. 3.

Referring to FIGS. 3 and 4, a male snap pin 56 is arranged on the lower surface of heel extension 48 and is set at a level so as not to protrude below the lower surface of the fixed heel 44. Another male snap pin 60 is arranged on sole 40 and mates with a female snap receptacle 62 in the upper surface of the heel extension member 48 thereby holding the heel extension 48 within storage compartment 46 until needed, i.e., until the wearer desires to extend the height of the heel assembly 42. Male snap pin 60 and female snap receptacle 62 may alternatively be located on opposing surfaces of the heel extension member 48 and fixed heel 44 when the heel extension member 48 is situated within the storage compartment 46.

To extend the heel, heel extension 48 may be grasped to separate snap pin 60 from the snap receptacle 62 and then rotated outward from storage compartment 46. In conjunction therewith, hinge 50 slides from the position shown in FIG. 5 downward to a lower position shown in FIG. 6 by virtue of the slidability of pin 52 in vertical slot 54. This permits the pivot point of hinge 50 to be adjusted vertically up and down thereby facilitating the mating of the heel extension 48 with the fixed heel 44 vis-a-vis cooperating engagement means 56,58 (discussed below). Alternatively, the hinge 50 may comprise a flexible sheet material such as film or cloth, a wire or a chain thereby providing the necessary 'play' to permit easy mating of the fixed heel 44 and the heel extension 48. FIG. 4 illustrates the embodiment of FIG. 3 with the heel extension 48 rotated outward from the storage compartment 46 and mated with the fixed heel 44.

Locking means are provided for securely attaching the heel extension member 48 to the fixed heel 44 when the heel is at the high height, i.e., the height provided by the combination of the fixed heel 44 and the heel extension member 48, and in the illustrated embodiment comprise a snap pin 56 which mates with a cooperating receptacle 58. Receptacle 58, located within the fixed heel 44, is in the form of a cavity having a narrow opening at its lower end and an upper end having a larger cross-sectional area than the lower end. This geometry for the receptacle 58 serves to prevent bits of street sand or grit from jamming or clogging the narrow opening of the receptacle 58 since sand or grit would easily be pushed into the wider upper portion of the receptacle 58 by the mating action of the male snap pin 56. In view of this construction, a secure but releasable attachment between the fixed heel 44 and the heel extension 48 is provided.

FIG. 5 is an enlarged side view of the hinge 50, pin 52, vertical slot 54, fixed heel 44, and heel extension 48 in a position in which the snap pin 60 is situated within snap receptacle 62. When the snap pin 60 separates from snap receptacle 62, hinge 50 is able to slide downward to the position shown in FIG. 6. This lowering of the pivot point of hinge 50 prevents interference between the mating surfaces of fixed heel 44 and heel extension 48.

The examples provided above are not meant to be exclusive. Many other variations of the present invention would be obvious to those skilled in the art, and are contemplated to be within the scope of the appended claims. For example, it is pointed out that the invention is useful and applicable for all shoes having heels, not only to womens' high-heel shoes. The heels in accordance with the invention can be incorporated into the shoes during the manufacturing of the shoes or possibly incorporated therein as a replacement for a conventional heel. In the embodiment shown in FIGS. 1 and 2, instead of the stepped hole and flanged pin, other types of biased members may be installed in the inner heel block 18 so long as movement of the inner heel block 18 is selectively enabled.

We claim:

1. A shoe comprising a sole, an upper arranged in connection with and above said sole, and a heel arranged below said sole, said heel comprising a first, downwardly oriented heel member arranged at a rear portion of and connected to said sole, said first heel member having an interior compartment and at least two vertically spaced apertures, a second heel member arranged in connection with said first heel member, said second heel member being movable relative to said first member between a first position in which said first heel member and said second heel member provide the heel with a first height and a second position in which said first heel member and said second heel member provide the heel with a second height greater than the first height, said second heel member when in said first position being positionable at least partially within said interior compartment of said first heel member, said second heel member having a hole in a peripheral surface alignable with each of said apertures in said first heel member, a pin arranged at least partially in said hole, and biasing means for biasing said pin in a direction outward from said hole and at least partially through one of said apertures in said first heel member when said second heel member is in said first position and said pin is in alignment with said aperture.

2. The shoe of claim 1, wherein said hole is a stepped hole having a first portion having a first diameter and a second portion having a second diameter greater than the first diameter, said pin including a flange in an intermediate position thereon movable in said second portion of said hole, said biasing means being arranged at least partially in said first portion of said hole.

3. The shoe of claim 1, wherein said first heel member includes guide means for guiding the movement of said second heel member.

4. The shoe of claim 3, wherein said guide means comprise a vertical groove arranged on an inner face of said first heel member.

5. The shoe of claim 4, wherein said vertical groove extends between said apertures, said pin being slidable in said vertical groove between said apertures.

6. The shoe of claim 1, wherein said pin includes a dimple on an end thereof adapted to project from said hole through said apertures.

7. The shoe of claim 1, wherein said second heel member is lockable in both said first position and said second position.

8. The shoe of claim 1, further comprising means for automatically moving said second heel member from said first position to said second position.

9. The shoe of claim 8, wherein said means for automatically moving said second heel member comprise a spring operatively connecting said first heel member and said second heel member, said spring being structured and arranged to provide a force which acts to move said second heel member relative to said first heel member.

10. The shoe of claim 1, wherein said biasing means are arranged to bias said pin in the direction outward from said hole and at least partially through another one of said apertures in said first heel member when said second heel member is in said second position and said pin is in alignment with said aperture.

11. A shoe comprising a sole, an upper arranged in connection with and above said sole, and a heel arranged below said sole, said heel comprising a first, downwardly oriented heel member arranged at a rear portion of and connected to said sole, said first heel member having an interior compartment, a second heel member positionable at least partially within said interior compartment of said first heel member, and displacement means for enabling displacement of said second heel member relative to said first member such that said second heel member is movable between a first position in which said first heel member and said second heel member provide the heel with a first height and a second position in which said first heel member and said second heel member provide the heel with a second height greater than the first height, said displacement means comprising said first heel member having at least two vertically spaced apertures, said second heel member having a hole in a peripheral surface alignable with each of said apertures, a pin arranged at least partially in said hole in said second heel member, and biasing means arranged in association with said pin for biasing said pin in a direction outward from said hole and at least partially through one of said apertures in said first heel member when said second heel member is in said first position and said pin is in alignment with said aperture.

12. The shoe of claim 11, wherein said second heel member is arranged at least partially within said interior compartment of said first heel member when in said first position.

13. The shoe of claim 11, wherein said hole is a stepped hole having a first portion having a first diameter and a second portion having a second diameter greater than the first diameter, said pin including a flange in an intermediate position thereon movable in said second portion of said hole, said biasing means being arranged at least partially in said first portion of said hole.

14. The shoe of claim 11, wherein said first heel member includes guide means for guiding the movement of said second heel member.

15. The shoe of claim 14, wherein said guide means comprise a vertical groove arranged on an inner face of said first heel member and extending between said apertures, said pin being slidable in said vertical groove between said apertures.

16. The shoe of claim 11, further comprising means for automatically moving said second heel member from said first position to said second position.

17. The shoe of claim 16, wherein said means for automatically moving said second heel member comprise a spring operatively connecting said first heel member and said second heel member, said spring being structured and arranged to provide a force which acts to move said second heel member relative to said first heel member.

18. The shoe of claim 11, wherein said biasing means are arranged to bias said pin in the direction outward from said hole and at least partially through another one of said apertures in said first heel member when said second heel member is in said second position and said pin is in alignment with said aperture.

19. A heel for a shoe, comprising a first, downwardly oriented heel member adapted to be arranged at a rear portion of and connected to a sole of the shoe, said first heel member having an interior compartment and at least two vertically spaced apertures, a second heel member arranged in connection with said first heel member, said second heel member being movable relative to said first member between a first position in which said first heel member and said second heel member provide the heel with a first height and a second position in which said first heel member and said second heel member provide the heel with a second height greater than the first height, said second heel member when in said first position being positionable at least partially within said interior compartment of said first heel member, said second heel member having a hole in a peripheral surface alignable with each of said apertures in said first heel member, a pin arranged at least partially in said hole, and biasing means for biasing said pin in a direction outward from said hole and at least partially through one of said apertures in said first heel member when said second heel member is in said first position and said pin is in alignment with said aperture.

20. A heel for a shoe, comprising a first, downwardly oriented heel member adapted to be arranged at a rear portion of and connected to a sole of the shoe, said first heel member having an interior compartment, a second heel member positionable at least partially within said interior compartment of said first heel member, and displacement means for enabling displacement of said second heel member relative to said first member such that said second heel member is movable between a first position in which said first heel member and said second heel member provide the heel with a first height and a second position in which said first heel member and said second heel member provide the heel with a second height greater than the first height, said displacement means comprising said first heel member having at least two vertically spaced apertures, said second heel member having a hole in a peripheral surface alignable with each of said apertures, a pin arranged at least partially in said hole in said second heel member, and biasing means arranged in association with said pin for biasing said pin in a direction outward from said hole and at least partially through one of said apertures in said first heel member when said second heel member is in said first position and said pin is in alignment with said aperture.

* * * * *